US007834536B2

(12) United States Patent
Takahashi et al.

(10) Patent No.: US 7,834,536 B2
(45) Date of Patent: Nov. 16, 2010

(54) LIGHT-EMITTING APPARATUS

(75) Inventors: Hisaya Takahashi, Kanagawa-ken (JP); Atsushi Namba, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 290 days.

(21) Appl. No.: 11/746,312

(22) Filed: May 9, 2007

(65) Prior Publication Data

US 2007/0262699 A1 Nov. 15, 2007

(30) Foreign Application Priority Data

May 9, 2006 (JP) ..... 2006-130666
Jan. 12, 2007 (JP) ..... 2007-004262

(51) Int. Cl.
*H01J 1/62* (2006.01)

(52) U.S. Cl. ..... 313/497; 313/495; 313/496

(58) Field of Classification Search ..... 313/495–497, 313/309–311
See application file for complete search history.

(56) References Cited

U.S. PATENT DOCUMENTS 5,717,288 A 2/1998 Huang
6,020,683 A 2/2000 Cathey, Jr. et al.
6,252,348 B1 6/2001 Lee
2001/0035922 A1 11/2001 Park et al.
2005/0194886 A1* 9/2005 Hsiao et al. ..... 313/495
2006/0001355 A1 1/2006 Cheng et al.

FOREIGN PATENT DOCUMENTS

EP 0549133 6/1993
JP 2000-251797 9/2000

OTHER PUBLICATIONS

European Patent Office, Supplementary European Search Report, European Patent Application No. 07107864.6 dated May 11, 2009, 7 pages.

* cited by examiner

*Primary Examiner*—Bumsuk Won
(74) *Attorney, Agent, or Firm*—Haynes and Boone, LLP

(57) ABSTRACT

A light-emitting apparatus of the present invention maintains an anode electrode 5 at a higher positive electric potential than a cathode electrode 15, applies an electric field to a cold-cathode electron emission source 16 by controlling a gate voltage applied to the cathode electrode 15 with a gate electrode 10, and emits excitation light from a phosphor 6 irradiated by an electron beam released from the cold-cathode electron emission source 16. The light-emitting apparatus of this invention emits the excitation light not only from the opposite side of the electron beam-irradiated surface of the phosphor 6 through a glass substrate 2, but also from the electron bean-irradiated surface of the phosphor 6 by reflecting the excitation light with a gate reflection surface 12 on the gate electrode 10 and emitting it through an unobstructed area Ro of the glass substrate 2. This eliminates the wasted excitation light emitted and absorbed within the apparatus as in the conventional light-emitting apparatuses to thereby improve the luminous efficiency and substantially increase the amount of light emitted outside from the entire illumination surface.

4 Claims, 3 Drawing Sheets

LIGHT-EMITTING APPARATUS

CROSS REFERENCE TO RELATED APPLICATIONS

This application claims priority under 35 U.S.C. 119 based upon Japanese Patent Application Serial No. 2006-130666, filed on May 9, 2006, and also based upon Japanese Patent Application Serial No. 2007-004262, filed on Jan. 12, 2007. The entire disclosures of the aforesaid applications are incorporated herein by reference.

FIELD OF THE INVENTION

The present invention relates to an apparatus for emitting light with a phosphor excited by field-emitted electrons from a cold-cathode electron emission source.

BACKGROUND OF THE INVENTION

As opposed to conventional light-emitting apparatuses such as candescent light bulbs and fluorescent light tubes, electron beam-excited light-emitting apparatuses have been recently developed for illumination or image display, using light-emitting phosphors (fluorescent materials) excited by high speed bombardment of electrons released from a field emission electron source in a vacuum vessel. In one of the structures generally used for this new type of apparatus, the light is emitted from a phosphor layer on a glass substrate and transmitted through the glass substrate toward the opposite side from the phosphor layer. In this structure, however, the luminous efficiency is compromised since the light is emitted the most on the electron-irradiated surface of the phosphor layer and wasted within the vacuum vessel.

Accordingly, in order to increase the brightness of the electron beam-excited display apparatuses, there is known a technique for forming a metal back layer by, for example, depositing aluminum on the electron-irradiated surface of the phosphor layer. As described in, for example, Japanese Unexamined Patent Application Publication No. 2000-251797, this metal back layer not only increases the brightness by reflecting the light from the phosphor emitted toward inside of the apparatus to the outer surface (display or illuminating side) of the apparatus with the specular reflection, but also protects the phosphor from damages by applying a predetermined electric potential to the phosphor surface, wherein the damages are caused by the electron charge on the phosphor surface and by the collision of negative ions generated within the apparatus against the phosphor surface.

In order to stabilize the marked quality level of an apparatus for forming and displaying images using light-emitting fluorescent film, the above Japanese Unexamined Patent Application Publication No. 2000-251797 uses a technique for dividing the metal back, disposed on the inner surface of the fluorescent film, into a plurality of portions, and coating the gaps between the portions with a conductive material to prevent creeping discharges on the gap portion surface caused by abnormal electric discharges occurring in vacuum.

However, the technique for using the metal back to improve the luminous efficiency of the apparatus leads to a reduction of the phosphor excitation efficiency due to the acceleration energy loss of the electron beam at the time of its entrance to the metal back layer. Particularly, in an application for an illumination apparatus, this decrease in phosphor excitation efficiency associated with the loss of the electron acceleration energy becomes nonnegligible and hinders the fundamental improvement of the luminous efficiency.

Considering the above situation, the purpose of the present invention is to provide a light-emitting apparatus capable of reducing the wasted excitation light emitted from the phosphor toward inside of the apparatus to thereby improve its luminous efficiency.

SUMMARY OF THE INVENTION

In order to achieve the above object, a light-emitting apparatus according to the present invention having at least a cold-cathode electron emission source and a phosphor on an anode side oppositely-disposed within a vacuum vessel for exciting the phosphor with an field-emitted electron beam from the cold-cathode electron emission source and emitting an excitation light to outside of the light-emitting apparatus comprises: a light-emitting area with the phosphor applied thereon and an unobstructed area without the phosphor applied thereon on the inner surface of a transparent base material forming a illustration surface; and a reflection surface in the vacuum vessel on the same side as the electron beam-irradiated surface of the phosphor for reflecting the excitation light from the phosphor and releasing the excitation light to the outside through the unobstructed area.

The light-emitting apparatus according to the present invention is capable of reducing the wasted excitation light from the phosphor emitted toward inside of the apparatus to thereby improve its luminous efficiency.

Having described the invention, the following examples are given to illustrate specific applications of the invention including the best mode now known to perform the invention. These specific examples are not intended to limit the scope of the invention described in this application.

Below, preferred embodiments of the present invention will be described in detail with reference to the accompanying diagrams.

DETAILED DESCRIPTION OF THE INVENTION

Figure 1:
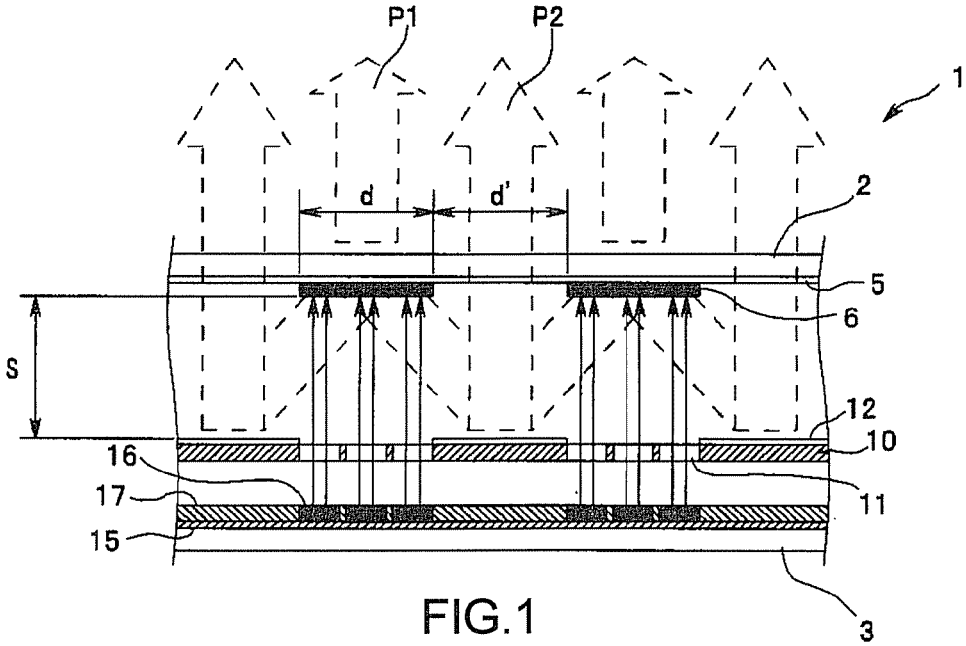
FIG. 1 is a basic block diagram of a light-emitting apparatus according to a first embodiment of the present invention.
Figure 2:
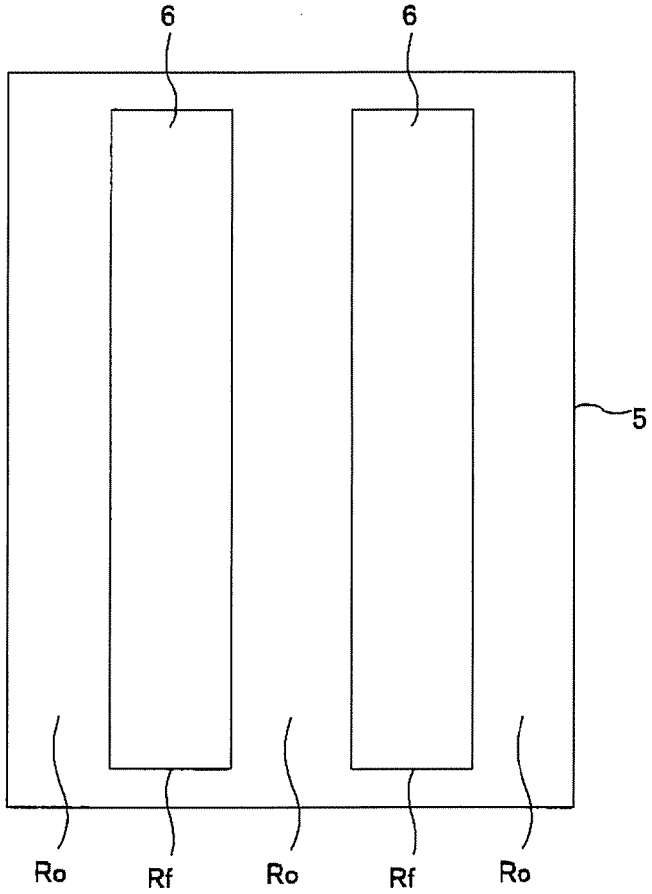
FIG. 2 is a plan view of a phosphor configuration according to the first embodiment of the present invention.
Figure 3:
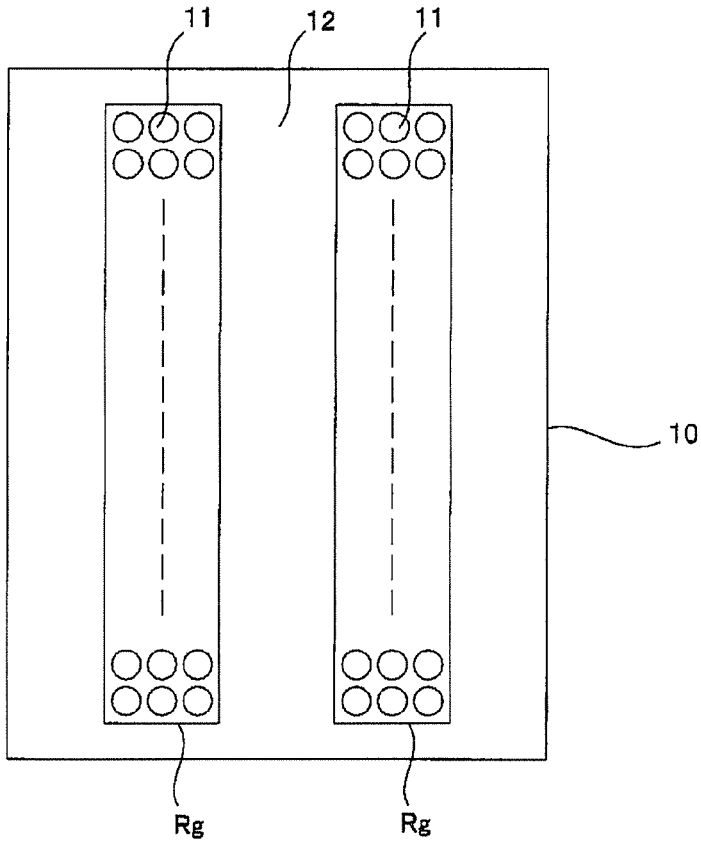
FIG. 3 is a plan view of a gate reflection surface configuration according to the first embodiment of the present invention.
Figure 4:
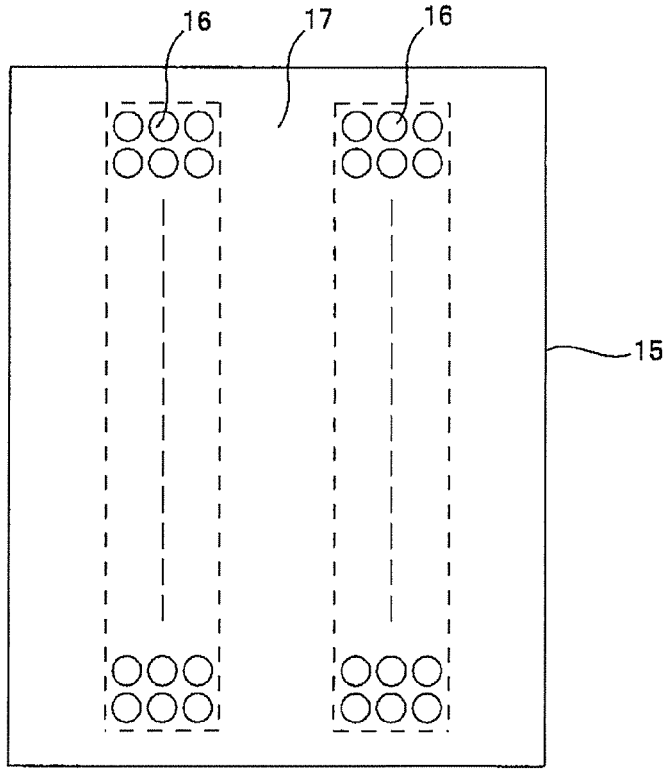
FIG. 4 is a plan view of a cold-cathode electron emission source configuration according to the first embodiment of the present invention.

Embodiments of the present invention will be described below in accordance with accompanying drawings. FIGS. 1-4 are according to a first embodiment of the present invention, wherein FIG. 1 is a basic block diagram of a light-emitting apparatus; FIG. 2 is a plan view of a phosphor configuration; FIG. 3 is a plan view of a gate reflection surface configuration; and FIG. 4 is a plan view of a cold-cathode electron emission source configuration.

In FIG. 1, a reference numeral 1 indicates a light-emitting apparatus which is used as, for example, a planar lamp. This light-emitting apparatus 1 comprises a vacuum vessel with its interior maintained in a vacuum state, defined by a glass substrate 2 and a glass substrate 3 on an illumination surface side and a base surface side, respectively, oppositely disposed at a predetermined interval, and a basic structure including an anode electrode 5, a gate electrode 10 and a cathode electrode 15 in the order from the illumination side to the base side in the vacuum vessel.

Although the light-emitting apparatus is illustrated with a three-electrode structure comprising the anode, gate and cathode electrodes in this embodiment, it should be noted that the present invention may be applied to a light-emitting apparatus with a two-electrode structure comprising oppositely-disposed anode and cathode electrodes without a gate electrode.

The anode electrode 5 is disposed on the inner surface of the glass substrate 2 as a transparent base material forming a illustration surface, and is composed of, for example, a transparent conductive film such as an ITO film. On the surface of this transparent conductive film, a phosphor 6 is applied facing the gate electrode 10 and the phosphor 6 emits light with excitation by electrons released from the cathode electrode 15. This phosphor 6 is deposited by, for example, the screen printing, inkjet, photography, precipitation or electrodeposition method, and is deposited not over the entire inner surface of the glass substrate 2, but for each predetermined area thereof.

For example, the phosphor 6 is deposited on each of elongated rectangular areas Rf arranged in a parallel manner on the interior surface of the glass substrate 2, as shown in FIG. 2. Between each of these areas Rf, each being a light-emitting region with the phosphor 6 applied thereon, there is provided an unobstructed area Ro with no phosphor 6 applied thereon. This unobstructed area Ro is a transparent window for transmitting and releasing the light from the excited surface of the phosphor 6 irradiated with an electron beam (electron beam-irradiated surface) emitted toward the gate electrode 10 and reflected to outside of the glass substrate 2 by reflection surfaces described below.

In the conventional light-emitting apparatus comprising a planar light-emitting surface, the phosphor is applied in a film-like manner to the entire inner surface of the glass substrate forming the illumination surface, and its excitation light will be emitted from the back side of the fluorescent film (opposite side of the electron beam-irradiated surface) and transmitted to outside through the glass substrate when irradiated with the electron beam within the vacuum vessel. Therefore, the conventional light-emitting apparatus comprises a structure in which the light is mostly emitted from the excitation surface (electron-irradiated surface) of the phosphor into the vacuum vessel and becomes wasted by, for example, being absorbed into the black cathode film surface consisting primarily of carbon.

In contrast, the light-emitting apparatus 1 according to the present invention comprises a structure for reflecting the strongest excitation light emitted from the electron beam-irradiated surface of the phosphor 6 toward inside of the vacuum vessel to outside through the unobstructed area Ro where there is no phosphor 6 on the inner surface of the glass substrate 2. This light reflected to outside through the unobstructed area Ro, combined with the light emitted from the opposite side of the phosphor 6 excitation surface, transmitted through the glass substrate 2 and released to outside, may substantially increase the amount of light emitted outside of the entire illumination surface of the light-emitting apparatus 1.

The surface for reflecting the light from the excitation surface of the phosphor 6 is provided on the gate electrode 10 in this embodiment. The gate electrode 10 is a flat electrode plate comprising gate apertures 11 for allowing the electrons released from the cathode electrode 15 to pass therethrough, made of conductive metal materials such as nickel, stainless steel and Invar, and formed using simple machining, etching, screen printing or the like. For example, the gate apertures 11 are formed as a plurality of circular bores in areas Rg corresponding to the fluorescent areas Rf of the phosphor 6, as shown in FIG. 3.

In addition, on the surface of the gate electrode 10 opposing to the anode electrode 5 around the areas Rg, there is provided a gate reflection surface 12 for reflecting the light emitted from the excited phosphor 6 toward inside of the vacuum vessel, as shown in FIG. 3. The gate reflection surface 12 comprises a reflection surface equal to or slightly larger in size than the unobstructed area Ro, and is formed by depositing on the gate electrode 10 a film of metal with high reflection characteristics such as aluminum, or by mirror-finishing the surface of the gate electrode 10. Note that appropriate post-process measures are required to suppress surface oxidation for the mirror-finishing of the gate electrode 10.

It should be appreciated that the reflection surface for reflecting the internally emitted light from the phosphor 6 may be formed as a separate member from the gate electrode 10. The reflection surface as a separate member from the gate electrode 10, may be disposed between the phosphor 6 and the gate electrode 10, or otherwise disposed on the gate electrode 10 patterned only with the areas Rg, at its lower side (the side toward the cathode electrode 15). In this case, the surface for reflecting the internally emitted light from the phosphor 6 is placed where the light from the phosphor 6 excitation surface may be optimally reflected and released to outside of the light-emitting apparatus through the unobstructed area Ro. A distance s between this reflection light and the phosphor 6 is preferably determined with, for example, an approximately 1:1 ratio ($s \approx d$) to a dimension d of the phosphor 6, shown in FIG. 1.

On the other hand, the cathode electrode 15 is comprised of a conductive material formed by, for example, depositing metals such as aluminum and nickel or applying and drying/calcining a silver paste material on the glass substrate 3 as the base surface. On the surface of this cathode electrode 15, cold-cathode electron emission sources 16 are formed by film-like application of emitter materials such as carbon nanotubes, carbon nanowalls, Spindt-type microcones or metal oxide whiskers.

The cold-cathode electron emission sources 16 are patterned corresponding to the excitation surface (light-emitting areas Rf) of the phosphor 6 by way of a cathode mask 17 for covering the surface of the cathode electrode 15 facing the back side of the gate reflection surface 12. For example, the cold-cathode electron emission sources 16 are defined by a plurality of circular patterns enclosed by the cathode mask 17, as shown in FIG. 4, and disposed within areas corresponding to the aperture areas Rg of the gate apertures 11, which in turn correspond to the light-emitting areas Rf of the phosphor 6.

Note that each of the circular bores forming the gate apertures 11 is equal to or slightly larger in size than each circular area of the cold-cathode electron emission sources 16, and that the cathode mask 17 covers the cathode electrode 15 with openings each equal to or smaller in size than each of the circular bores forming the gate apertures 11.

The cathode mask 17 is formed of conductive members and typically maintained at the ground electric potential. This prevents the electric field from concentrating around the circumferential edge of the cold-cathode electron emission sources 16 and also prevents the electrons released from the cold-cathode electron emission sources 16 from colliding into the gate electrode 10 in order to ensure no metal sputtering occurs, and allow nearly all electrons from the cold-cathode electron emission sources 16 to pass through the gate apertures 11 of the gate electrode 10 and reach the phosphor 6 on the anode electrode 5 as effective electrons contributing to the light emission so that the electric power loss at the gate electrode 10 is effectively reduced.

Note that the cold-cathode electron emission sources 16 may be uniformly deposited on the cathode electrode 15 and that the cathode mask with openings each approximately equal in size to each gate aperture 11 of the gate electrode 10 may be disposed over the uniformly deposited cold-cathode electron emission sources 16 Furthermore, the cathode mask 17 may be omitted by patterning the cathode electrode 15 and the cold-cathode electron emission sources 16 to eliminate the electrode surface exposure.

Although the light-emitting apparatus 1 of the present embodiment has a three-electrode structure comprising the anode electrode 5, gate electrode 10 and cathode electrode 15, it should be understood that, for a light-emitting apparatus of two-electrode structure with anode and cathode electrodes, a mirror surface may be formed on the surface of the cathode mask 17 or a similarly shaped member as a surface for reflecting the internally emitted light from the phosphor 6.

Next operations of the light-emitting apparatus 1 according to the present embodiment will be described below. In the light-emitting apparatus 1, the anode electrode 5 is maintained at a higher electric potential than the cathode electrode 15, and the phosphor 6 emits excitation light caused by the electrons controlled by a gate voltage applied and adjusted at the gate electrode 10, and releases the light to outside through the glass substrate 2. In other words, when an electric field is applied to the cold-cathode electron emission sources 16 and the field concentrates on the solid surface forming the cold-cathode electron emission sources 16, the phosphor 6 is irradiated with the electron beam released from the solid surface and accelerated toward the anode electrode 5 through the gate apertures 11 of the gate electrode 10. During this electron beam irradiation, the electrons collide with and excite the phosphor 6 to cause its light emission.

In this case, the light emitted from the glass substrate 2 (as an illumination surface of the light-emitting apparatus 1) is of two origins: emitted light P1 from the light-emitting areas Rf through the glass substrate 2, and emitted light P2 from the unobstructed area Ao, as shown in FIG. 1. The emitted light P1, from the light-emitting areas Rf, is first released from the excited surface of the phosphor 6, transmitted through the granular membrane of the phosphor 6 and the glass substrate 2 adjacent to the membrane, and emitted outside of the light-emitting apparatus 1, whereas the emitted light P2 is a reflected light first released from the excited surface of the phosphor 6, reflected by the gate reflection surface 12, transmitted through the unobstructed area Ro of the glass substrate 2, and emitted outside of the apparatus 1.

With these emitted lights P1 and P2 combined and optimized by configuring the electron beam density irradiated onto the phosphor 6 according to the ratio between the light-emitting areas Rf and the unobstructed area Ro, the light-emitting apparatus 1 can substantially increase the amount of light it emits outside and reduce its electric consumption compared to the conventional light-emitting apparatuses with the phosphor covering the entire inner surface of their glass substrate 2.

For example, if d=d', wherein d is the dimension of each light-emitting area Rf with the phosphor 6 applied thereon and d' is a dimension of unobstructed area Ro, the light-emitting apparatus 1 can double the amount of light it releases outside by doubling the density of the electron beam for exciting the phosphor 6 compared to the conventional light-emitting apparatuses while maintaining the average electron beam density per unit area.

As described above, the present embodiment allows the excitation light from the phosphor irradiated by the electron beam to be emitted outside both from the opposite side of the excitation surface through the glass substrate 2 and from the excitation surface by reflecting the light emitted toward inside of the vacuum vessel and transmitting it through the unobstructed area Ro on the glass substrate 2. This eliminates the wasted excitation light emitted toward inside of the apparatus to thereby improve the luminous efficiency and substantially increase the amount of light emitted outward from the entire illumination surface compared to the conventional light-emitting apparatuses.

In addition, compared to the conventional light-emitting apparatuses, the light-emitting apparatus of the present invention permits not only to substantially increase the amount of light it emits outside, but also to substantially reduce its electric consumption for energy conservation while maintaining the equivalent amount of light to that of the conventional light-emitting apparatuses by configuring the electron beam density for phosphor excitation based on the ratio between the light-emitting areas with the phosphor applied thereon and the unobstructed areas without the phosphor.

Figure 5:
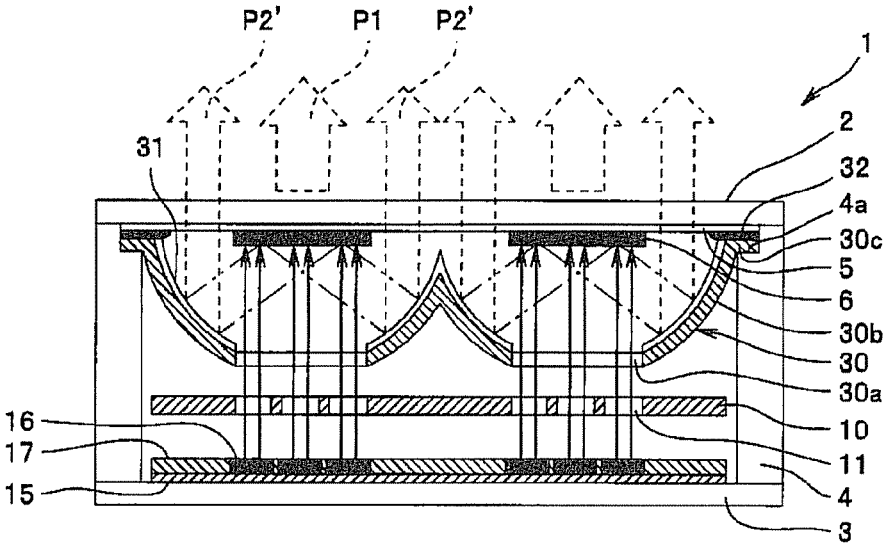
FIG. 5 is a basic block diagram of a light-emitting apparatus according to a second embodiment of the present invention.
Figure 6:
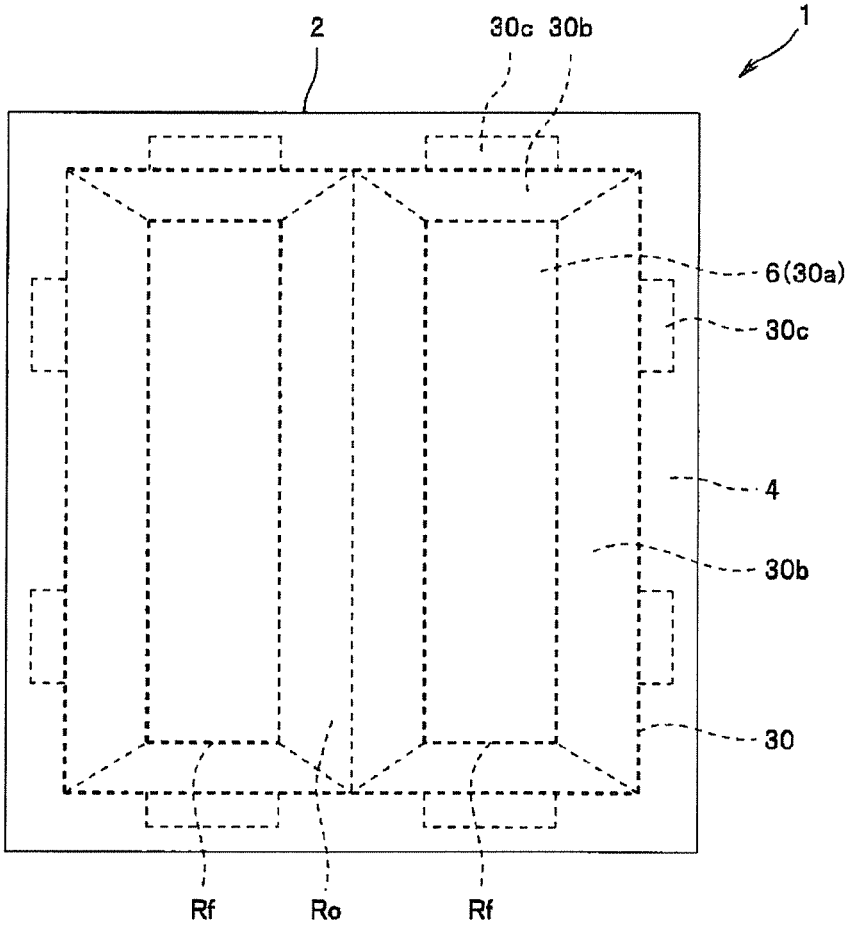
FIG. 6 is a plan view showing a configuration of a phosphor and a reflection plate according to the second embodiment of the present invention.

Now referring to FIGS. 5 and 6, FIG. 5 is a basic block diagram of a light-emitting apparatus; and FIG. 6 is a plan view showing a configuration of a phosphor and a reflection plate, respectively, according to the second embodiment of the present invention. Here, a specific configuration of this embodiment is described wherein a surface for internally reflecting the light from a phosphor 6 is provided separately from a gate electrode 10. For configurations similar to the above-mentioned first embodiment, the same reference numerals are used and their descriptions are omitted accordingly.

In the present embodiment, a reflection plate 30 is disposed between an anode electrode 5 and an gate electrode 10 as a separate member from the gate electrode 10, as shown in FIGS. 5 and 6.

The reflection plate 30 may be constructed of a plate material using a host material such as an aluminum-based conductive metal material with small thermal deformation, thermal alteration and the like. In this reflection plate 30, apertures 30*a* are provided in areas corresponding to gate apertures 11 and slopes 30*b* are additionally formed around each aperture 30*a* so that the slopes 30*b* are further spaced apart from the anode electrode 5 as the slopes 30*b* approach the aperture 30*a*. Furthermore, reflection surfaces 31 are formed on the slopes 30*a* facing a glass substrate 2 for reflecting the internally emitted light from the phosphor 6.

Here in the present embodiment, each aperture 30*a* is specifically formed in a rectangular shape to approximately correspond with the rectangular shape of each area Rg.

Also in order to guide the internally emitted light to an unobstructed area Ro efficiently, the shape of the slopes 30*b* (reflection surfaces 31) may be configured with various cross-sectional shapes such as ellipsoid, parabola and hyperbola according to the surface area of the phosphor 6 and the distance between the phosphor 6 and the reflection plate 30. In the present embodiment, the slopes 30*b* are configured parabolic, for example.

Although the reflection surfaces 31 may be formed, for example, by mirror-finishing the surface of the slopes 30*b*, the reflection surfaces 31 are preferably formed by depositing a film of metal with high reflection characteristics and small thermal deformation, thermal alteration and the like on the slopes 30*b* for a high reflectivity.

The reflection plate 30 constructed as above is retained within a vacuum vessel, for example, by support portions 30*c* each extendingly formed from the circumferential edge of each slope 30*b*.

Specifically illustrated in FIG. 5, the vacuum vessel of the present embodiment comprises and constructed with the glass substrate 2 with the phosphor 6 applied thereon, a glass substrate 3 comprising cold-cathode electron emission sources 16 thereon, and a framework 4 sandwiched between the glass substrates 2 and 3. The sealing of the vacuum vessel is achieved by, for example, welding the respective rim portion of the glass substrates 2 and 3 to the framework 4 with a low-melting glass or the like by liquid state joining in a vacuum furnace. In the inner side of this framework 4 edge where it joins with the glass substrate 2, there are provided shoulders 4*a* each corresponding to the respective support portion 30*c* of the reflection plate 30 for sandwiching the reflection plate 30 between the glass substrate 2 and the framework 4 by placing each support portion 30*c* into the respective shoulder 4*a* in a sealing process of the vacuum vessel. A silver bond 32 is applied during the above sealing process onto the surface of the support portions 30*c* opposing the glass substrate 2, allowing the reflection plate 30 to be electrically connected with the anode electrode 5 via this silver bond 32.

According to such an embodiment, the reflection surfaces 31 may be designed with high degree of freedom without significant restrictions from specifications of the gate electrode 10 and the like, and may efficiently direct the internally emitted light from the phosphor 6 to the unobstructed area Ro by providing the reflection plate 30 configured as a separate member from the gate electrode 10 in the vacuum vessel and forming the reflection surfaces 31 on the reflection plate 30. Particularly, by providing the separate reflection plate 30 from the gate electrode 10, the shape or the like of the reflection surfaces 31 may be designed with high degree of freedom in the depth direction (from the phosphor 6 side to the gate electrode 10 side) so that the internally emitted light may be efficiently guided to the unobstructed area Ro. Moreover, since the material for the reflection plate 30 may be selected with no restrictions from the gate electrode 10, a high reflectivity can be ensured for the reflection surfaces 31 even after thermal processes such as one for sealing the vacuum vessel by constructing the reflection plate 30 (and its metal film and the like) of a material with small thermal deformation, thermal alteration and the like. Thus, emitted light P2' emitted from the unobstructed area Ro can be considerably increased.

Furthermore, by electrically connecting the reflection plate 30 with the anode electrode 5, electric charge in the reflection plate 30 disposed within the vacuum vessel may be prevented for a stable electric field in the vacuum vessel and for a precise guidance of the electrons released from the cold-cathode electron emission sources 16 to the anode electrode 5.

Moreover, the reflection plate 30 may be supported inside the vacuum vessel with a simple structure by sandwiching the reflection plate 30 between the glass substrate 2 and the framework 4.

Although the reflection plate 30 is sandwiched between the glass substrate 2 and the framework 4, and electrically connected with the anode electrode 5 in the second embodiment described above, it should be mentioned that the present invention is not limited to this configuration and the reflection plate 30 can be, for example, supported on the gate electrode 10 side. In this case, if the reflection plate 30 is connected to the gate electrode 10 instead of the anode electrode 5, the electric charge of the reflection plate 30 may be appropriately prevented.

Obviously, many modifications and variations of the present invention are possible in light of the above teachings. It is therefore to be understood that, within the scope of the appended claims, the invention may be practiced otherwise than as specifically described.

What is claimed is:

1. A light-emitting apparatus having at least a cold-cathode electron emission source and a phosphor on an anode side oppositely-disposed within a vacuum vessel for exciting said phosphor with a field-emitted electron beam from said cold-cathode electron emission source and emitting an excitation light to an outside of said light-emitting apparatus through a transparent base material disposed at said anode side, comprising:

a light-emitting area with said phosphor applied thereon and an unobstructed area without said phosphor applied thereon on an inner surface of the transparent base material forming an illustration surface; and a reflection surface in said vacuum vessel for reflecting the excitation light from said phosphor toward the side of the electron beam-irradiated surface of said phosphor, and releasing the excitation light to the outside through said unobstructed area of said transparent base material, said reflection surface being formed on a reflection plate provided between a gate electrode and said anode side, said gate electrode being disposed between said cold-cathode electron emission source and said phosphor for controlling a voltage applied to said cold-cathode electron emission source, said reflection plate being disposed as a separate member from said gate electrode, wherein said reflection plate comprises an aperture corresponding to an aperture of said gate electrode, and a slope, said slope being spaced farther apart from said anode side as said slope approaches said aperture of said reflection plate, wherein said reflection surface is formed on said slope, and wherein a circumferential edge of said slope is electrically connected to said anode side.

2. The light-emitting apparatus of claim 1, wherein a cathode electrode with said cold-cathode electron emission source formed thereon is provided with a cathode mask for covering a surface of said cathode electrode facing the back side of said reflection surface.

3. The light-emitting apparatus of claim 1, wherein said vacuum vessel comprises said transparent base material and a framework, said framework joined with the rim portion of said transparent base material, wherein said reflection plate is sandwiched between said transparent base material and said framework.

4. The light-emitting apparatus of claim 1, wherein the density of the electron beam for exciting said phosphor is configured according to a ratio between said light-emitting area and said unobstructed area.

* * * * *